United States Patent [19]

Seong et al.

[11] Patent Number: 5,011,435

[45] Date of Patent: Apr. 30, 1991

[54] MODULAR JACK

[75] Inventors: Teresa A. Y. C. Seong; Yap Y. Teck, both of Singapore, Singapore

[73] Assignee: Molex Incorporated, Lisle, Ill.

[21] Appl. No.: 504,768

[22] Filed: Apr. 5, 1990

[51] Int. Cl.[5] ..... H01R 13/00

[52] U.S. Cl. ..... 439/676

[58] Field of Search ..... 439/676, 660, 682

[56] References Cited

U.S. PATENT DOCUMENTS

| | | | |
|---|---|---|---|
| 4,210,376 | 7/1980 | Hughes et al. | 439/676 |
| 4,221,458 | 9/1980 | Hughes et al. | 439/676 |
| 4,225,209 | 9/1980 | Hughes | 439/676 |

*Primary Examiner*—Joseph H. McGlynn

*Attorney, Agent, or Firm*—Louis A. Hecht; Stpehen Z. Weiss; A. A. Tirva

[57] ABSTRACT

A modular jack is disclosed and includes an insulating body having a plug insertion hole formed in a front end of the body for receiving therein a complementary plug having contact means. The body includes contact insertion holes communicating with the plug insertion hole and contact insertion slots inside the plug insertion hole at entrances to the contact insertion holes. Jack contacts are inserted into the contact insertion holes with free and portions of the contacts exposed inside the plug insertion hole in the body for contacting the plug contact means. The contact insertion slots are sized relative to the size of the jack contacts so that there is provided an interference fit therebetween to maintain proper positioning of the contacts and to prevent the contacts from backing out of the contact insertion holes.

18 Claims, 1 Drawing Sheet

MODULAR JACK

FIELD OF THE INVENTION

This invention relates to modular jacks which are used widely in the telephone industry, for example.

BACKGROUND OF THE INVENTION

In the telephone industry, conventional connectors are provided in the form of a modular plug and a modular jack. The jack may be installed on the wall of a room or on the body of a telephone so that it can be connected to the modular jack installed at the end of a cable, to provide connection between the telephone and an external line.

Such modular jack-type connectors also have been used widely on equipment other than telephone equipment, such as data processing equipment which may be incorporated adjacent to a telephone exchange, computers and like equipment. The use of such modular jacks in this type of equipment often requires that the jack be mounted on a circuit board.

Most such jacks include an insulating body made of plastic material, with a plug insertion hole formed in a front end of the body to receive a plug having contact means. Wire contacts are assembled in the insulating body, inserted into contact insertion holes therein, with free spring end portions exposed in the plug insertion hole in the body for contacting the plug contact means when the plug is inserted into the insertion hole.

A continuing problem with such modular jacks is in mounting the conductive spring contacts in the insertion holes of the insulating body and maintaining the contacts in proper position. A dilemma is encountered in sizing the insertion holes so that the contacts easily can be inserted thereinto, but still maintaining the contacts in proper position for engaging the plug contact means as well as preventing the contacts from backing out of the insertion holes when exteriorly exposed tail portions of the contacts are electrically coupled to external circuitry, such as inserting the tail portions into holes in a printed circuit board. If the contact insertion holes in the body are too small, it is very difficult to simultaneously insert a plurality of contacts in a mass production environment. If the insertion holes are too large, the contacts have a tendency to misalign and can back out of the insertion holes.

This invention is directed to solving this continuing problem by providing a modular jack construction wherein the spring contacts are easily inserted into the insulating body and still maintained in proper position by interference fits.

SUMMARY OF THE INVENTION

An object, therefore, of the invention is to provide a new and improved modular jack of the character described.

In the exemplary embodiment of the invention, the modular jack includes an insulating body having a plug insertion hole formed in a front end thereof for receiving therein a complementary plug having contact means. The insulating body includes contact insertion holes, communicating with the plug insertion hole, and contact insertion slots inside the plug insertion hole at entrances to respective ones of the contact insertion holes. Jack contacts are inserted into the contact insertion holes with free end portions exposed inside the plug insertion hole in the body for contacting the plug contact means. The contact insertion slots are sized relative to the size of the jack contacts so that there is provided an interference fit therebetween to prevent the jack contacts from backing out of the contact insertion holes.

The free end portion of each jack contact is folded back toward an inner end of the plug insertion hole. Each contact insertion hole extends oblique to the direction of insertion of the plug to orient an intermediate portion of the jack contact at an oblique angle to the free end portion of the contact. A tail portion of the contact extends from the body out of an open end of the respective contact insertion hole opposite the entrance to the insertion hole. The tail portion extends perpendicular to the direction of insertion of the plug into the plug insertion hole. A folded portion of the jack contact, between the free end portion and the intermediate portion, is located in the respective contact insertion slot providing the interference fit therewith.

With the above configuration, it is contemplated that the contact insertion slots be located to one side of the respective contact insertion holes whereby the jack contacts can be inserted freely into the contact insertion holes and then the folded portions are positioned in the contact insertion slots.

The insulating body also is provided with enlarged recesses at the entrances to the contact insertion holes to facilitate guiding the jack contacts into the insertion holes.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
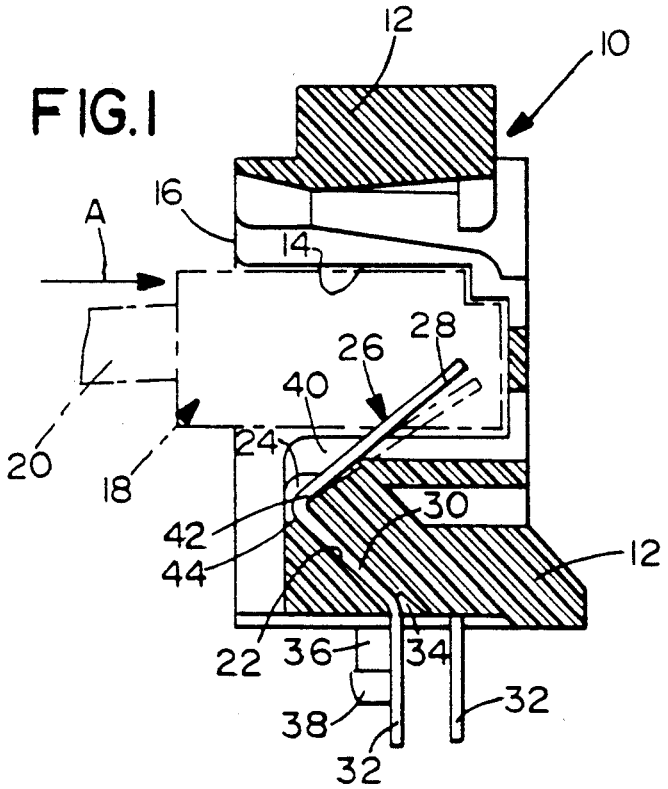
FIG. 1 is a vertical section through a modular jack incorporating the concepts of the invention.

Referring to the drawings in greater detail, the invention is embodied in a modular jack, generally designated 10, which includes an insulating body 12 having a plug insertion hole 14 formed in a front end 16 of the body. The plug insertion hole is sized and shaped for receiving therein a complementary plug, shown generally in phantom at 18 in FIG. 1 and including appropriate contact means (not shown). An electrical cable, shown in phantom at 20, is connected to plug 18.

Insulating body 12 includes a plurality of contact insertion holes 22 communicating with plug insertion hole 14. As will be described in greater detail hereinafter, the body also includes a plurality of contact insertion slots 24 inside or near plug insertion hole 14 at entrance areas for the contact insertion holes.

The modular jack also includes a plurality of jack contacts 26 inserted into contact insertion holes 22 with free spring end portions 28 exposed inside the plug insertion hole in the body for contacting the plug contact means. As is known in the art, as plug 18 is inserted into plug insertion hole 14 in body 12, the free end portions 28 of the contacts are sprung downwardly for maintaining the contacts in engagement with the contact means of the plug.

Comparing FIG. 2 with FIG. 1 and also looking at FIG. 3, it can be seen that jack contacts 26 are alternatingly offset in a horizontal direction for reducing the size of the jack as well as spacing the contacts either for mating with appropriate terminals or for connection to closely spaced circuit traces on a printed circuit board, as further described hereinafter.

It can be seen that contact insertion holes 22 extend oblique to the direction of insertion of plug 18, as indicated by arrow "A" (FIG. 1) which thereby orients an intermediate portion 30 of the jack contacts at oblique angles to the free end portions 28 of the contacts. The contacts also have tail portions 32 extending from body 12 out of open ends 34 of contact insertion holes 22. The tail portions extend out of the bottom of insulating body 12 perpendicular to the direction of insertion of plug 18, i.e. perpendicular to arrow "A". This configuration of modular jack 10 is designed so that tail portions 32 can be inserted through appropriate holes in a printed circuit board for soldering to the circuit traces on the circuit board (not shown). To this end, insulating body 12, which is fabricated of appropriate plastic material, is provided with integrally molded, split posts 36 for mounting the jack into appropriate holes in the circuit board, with enlarged head portions 38 of the posts provided for snapping outwardly beneath the underside of the board to securely hold the modular jack to the board.

As stated in the "Background", above, a continuing problem with modular jacks as described above centers around the mounting and/or positioning of jack contacts 26 in insulating body 12 in such a manner that the contacts can be easily inserted into contact insertion holes 22 to support a mass production environment, yet the contacts must be sufficiently retained to maintain their respective positions for engaging the complementary contact means on plug 18 and to prevent the contacts from backing out of contact insertion holes 22 when the contacts are assembled to the printed circuit board. If contact insertion holes 22 are made too large to facilitate ease of assembly, the contacts are provided with too much "play" and can become misaligned and can back out of their respective holes. If the contact insertion holes are made too tight in respect to the dimensions of the contacts, assembly techniques become very difficult and require expensive precision assembly equipment.

The invention contemplates solving the above problems, generally, by providing an interference fit between insulating housing 12 and jack contacts 26 in a manner which still allows for easy insertion of the contacts into insertion holes 22.

Figure 3:
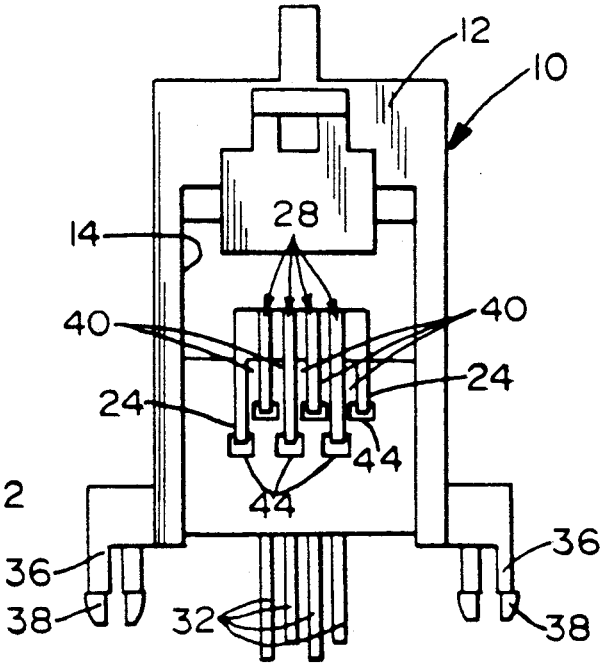
FIG. 3 is a front elevational view of the modular jack, with the two outside contacts removed to facilitate the illustration.

More particularly, the contacts are separated by ribs 40 molded integral with body 12 and which can be seen in elevation in FIG. 3. The ribs are separated a width substantially equal to the interior dimension of contact insertion holes 22. These dimensions are sufficiently larger than the cross-sectional dimensions of jack contacts 26 to allow for easy, free insertion of the contacts into the body and to facilitate insertion of a plurality of contacts simultaneously in a mass production environment. However, the distance between ribs 40 are reduced in areas adjacent to the entrances to insertion holes 22 to define the aforementioned contact insertion slots 24. These insertion slots 24 are sized relative to the cross-sectional dimensions or size of jack contacts 26 so that there is provided an interference fit between the contacts at the insertion slots to retain the contacts in their proper alignment and to prevent the contacts from backing out of insertion holes 22.

Figure 2:
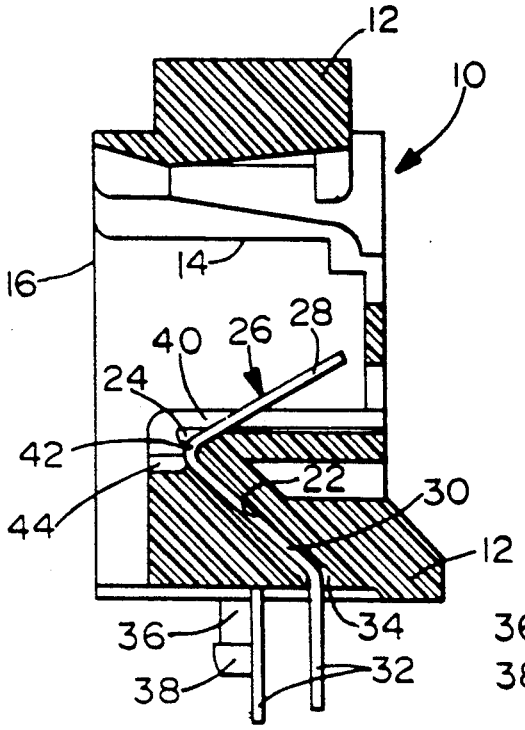
FIG. 2 is a vertical section similar to that of FIG. 1 but horizontally offset to illustrate one of the alternatingly offset jack contacts.

It can be seen in FIGS. 1 and 2 that contact insertion slots 24 are positioned to one side or offset from the entrances to contact insertion holes 22, with a folded area 42 of the contacts, between free end portions 28 and intermediate portions 30, located in the reduced dimensioned insertion slots 24.

During manufacture and/or assembly of modular jack 10, tail portions 32 of jack contacts 26 can begin as continuations of or colinear with intermediate portions 30 of the contacts. Therefore, the distal ends of the contacts defined by the distal ends of tail portions 32 are inserted into the entrances at the top of insertion holes 22 as viewed in the drawings. To this end, and referring particularly to FIG. 3 in conjunction with FIGS. 1 and 2, enlarged recesses 44 are molded integrally in insulating body 12 at the entrances to contact insertion holes 22 for guiding the distal ends of the jack contacts into the holes. As the contacts are inserted completely into the insertion holes, folded areas 42 of the contacts wedge into contact insertion slots 24 to establish an interference fit therein. In other words, with insertion slots being offset to one side (above in the drawings) of the entrances to contact insertion holes 22, the reduced sized slots do not interfere with the contacts being inserted into the larger holes. After complete insertion, tail portions 32 are bent out of their colinear relationship with intermediate portions 30 to configurations as shown in FIGS. 1 and 2, whereby the tail portions extend perpendicularly out of the bottom of body 12 for ready assembly into appropriate mounting holes in a printed circuit board. It should be understood that providing the contacts with tail portions 32 is disclosed in a preferred or existing mode of the invention. As stated in the "Background", above, the modular jack may be configured for other applications and still embody the novel interference fit provided between the contacts and the insulating body.

Alternate methods of manufacture/assembly are contemplated. For instance, each contact can be entirely straight prior to insertion, with the tail portions bent after insertion as described above, as well as folding the free end portions 28 to the configuration shown resulting in the folded areas 42 being forcibly folded into insertion slots 24. Or, the tail portions can be pre-bent as shown, with free end portions 28 forming linear continuations of intermediate portions 30. The free end portions then would be inserted into insertion holes 22 through open ends 34. Once inserted, free end portions 28 can be folded to forcibly fold the folded areas 42 into insertion slots 24.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A modular jack, comprising:

an insulating body having a plug insertion hole formed in a front end thereof for receiving therein a complementary plug having appropriate contact means, contact insertion holes in the body communicating with the plug insertion hole, and contact insertion slots int he body inside the plug insertion hole at entrances tot he contact insertion holes;

jack contacts inserted into the contact insertion holes with free end portions of the contacts exposed inside the plug insertion hole in the body for contacting the plug contact means; and wherein a portion of each jack contact engages its respective contact insertion slot, the contact insertion slots being sized relative to the size of the jack contacts so that there is provided an interference fit therebetween to prevent the jack contacts from backing out of the contact insertion holes.

2. The modular jack of claim 1 wherein said free end portions of the jack contacts are folded back toward an inner end of the plug insertion hole and said contact insertion holes extended oblique to the direction of insertion of the plug to orient intermediate portions of the jack contacts at oblique angles to the free end portions of the jack contacts.

3. The modular jack of claim 2, including folded areas of said jack contacts located in the contact insertion slots.

4. The modular jack of claim 2 wherein said jack contacts have tail end portions extending freely from the insulating body out of open ends of the contact insertion holes opposite the entrances to the insertion holes.

5. The modular jack of claim 4 wherein said free tail end portions extend perpendicular to the direction of insertion of the plug into the plug insertion hole forming oblique angles with the intermediate portions of the contacts located within the contact insertion holes.

6. The modular jack of claim 2 wherein said contact insertion slots are located to one side of the respective contact insertion holes whereby the jack contacts can be inserted freely into the contact insertion holes and then folded into the contact insertion slots.

7. The modular jack of claim 6, including enlarged recesses in the insulating body at the entrances to the contact insertion holes for guiding the jack contacts thereinto.

8. A modular jack, comprising:

an insulating body having receptacle means for receiving therein a complementary plug having appropriate contact means, contact insertion holes in the body and contact insertion slots in the body at entrances to the contact insertion holes;

jack contacts inserted into the contact insertion holes with free end portions of the contacts exposed inside and folded back toward an inner end of the receptacle means for contacting the plug contact means; and wherein the folded back portion of each jack contact engages its respective contact insertion slot the contact insertion slots being sized relative tot he size of the jack contacts so that there is provided an interference fit therebetween to prevent the jack contacts from backing out of the contact insertion holes.

9. The modular jack of claim 8 wherein said contact insertion holes extend oblique to the direction of insertion of the plug to orient intermediate portions of the jack contacts at oblique angles to the free end portions of the jack contacts.

10. The modular jack of claim 9 wherein said jack contacts have tail end portions extending freely from the insulating body out of open ends of the contact insertion holes opposite the entrances to the insertion holes.

11. The modular jack of claim 10 wherein said free tail end portions extend perpendicular to the direction of insertion of the plug into the receptacle means forming oblique angles with the intermediate portions of the contacts located within the insertion holes.

12. The modular jack of the claim 1 wherein said contact insertion slots are located to one side of the respective contact insertion holes whereby the jack contacts can be inserted freely into the contact insertion holes and then folded into the contact insertion holes.

13. The modular jack of claim 12, including enlarged recesses in the insulating body at the entrances to the contact insertion holes for guiding the jack contacts thereinto.

14. A modular jack, comprising:

an insulating body having a plug insertion hole formed in a front end thereof for receiving therein a complementary plug having appropriate contact means, contact insertion holes in the body communicating with the plug insertion hole and extending oblique to the direction of insertion of the plug, and contact insertion slots in the body inside the plug insertion hole at entrances to the contact insertion holes;

jack contacts including intermediate portions in the contact insertion holes, free end portions folded back toward an inner end of the plug insertion hole, tail portions extending from the insulating body out of open ends of the contact insertion holes opposite the entrances to the insertion holes, and folded areas of the contacts between the free end portions and intermediate portions thereof located in the contact insertion slots; and wherein the contact insertion slots are sized relative to the size of the folded areas of the jack contacts so that there is provided an interference fit therebetween to prevent the jack contacts from backing out of the contact insertion holes.

15. The modular jack of claim 14 wherein said tail portions extend perpendicular to the direction of insertion of the plug into the plug insertion hole.

16. The modular jack of claim 14 wherein said contact insertion slots are located to one side of the respective contact insertion holes whereby the jack contacts can be inserted freely into the contact insertion holes and then folded into the contact insertion slots.

17. The modular jack of claim 14, including enlarged recesses in the insulating body at the entrances to the contact insertion holes for guiding the jack contacts thereinto.

18. The modular jack of claim 1 or 8 or 14 wherein each jack contact has a substantially uniform cross section throughout.

* * * * *